US006076720A

United States Patent [19]

Deng

[11] Patent Number: 6,076,720

[45] Date of Patent: Jun. 20, 2000

[54] STAPLER WITH STAPLES OF DIFFERENT SIZES

[76] Inventor: Jinn-Yi Deng, No. 11, Alley 10, Chung-Tsun Lane, Yung-Chun Village, Hua-Tan Hsiang, Chang Hua Hsien, Taiwan

[21] Appl. No.: 09/120,308

[22] Filed: Jul. 22, 1998

[51] Int. Cl.[7] ..... B25C 5/02; B25C 5/16

[52] U.S. Cl. ..... 227/109; 227/119; 227/120; 227/123; 227/156

[58] Field of Search ..... 227/109, 156, 227/120, 119, 123, 107, 131, 139

[56] References Cited

U.S. PATENT DOCUMENTS

| | | | |
|---|---|---|---|
| 1,735,195 | 11/1929 | Bates | 227/120 |
| 2,117,741 | 5/1938 | Polzer | 227/123 |
| 2,716,749 | 9/1955 | Timmerbeil | 227/109 |
| 2,853,707 | 9/1958 | Juilfs | 227/139 |
| 3,524,575 | 8/1970 | Hurkmans et al. | 227/131 |
| 3,583,622 | 6/1971 | Graeff | 227/120 |
| 3,834,602 | 9/1974 | Obergfell | 227/109 |
| 4,182,474 | 1/1980 | Sato | 227/120 |
| 4,552,296 | 11/1985 | Sheng | 227/109 |
| 4,556,161 | 12/1985 | Oide | 227/109 |
| 4,805,824 | 2/1989 | Erickson | 227/120 |
| 5,575,415 | 11/1996 | Sucher | 227/109 |
| 5,632,431 | 5/1997 | Lin | 227/109 |
| 5,692,665 | 12/1997 | Lee | 227/119 |
| 5,794,832 | 8/1998 | Chen | 227/109 |
| 5,931,364 | 8/1999 | Dennis | 227/109 |
| 5,931,365 | 8/1999 | Huang | 227/109 |

*Primary Examiner*—Peter Vo
*Assistant Examiner*—Jim Calve
*Attorney, Agent, or Firm*—Watson Cole Grindle Watson, P.L.L.C.

[57] ABSTRACT

A stapler includes a base having a first end portion and a second end portion, a first staple magazine having a first end portion pivotally connected with the first end portion of the base and a second end portion formed with a closed face and containing a staple ejection slot on the bottom portion thereof, a second staple magazine received in the first staple magazine and having a first end portion connected with the first end portion of the first staple magazine and a second end portion, a plurality of first staples each slidably mounted on the second staple magazine and received in the first staple magazine, a plurality of second staples each slidably received in the second staple magazine, and a pressing cap having a first end portion pivotally mounted on the first end portion of the base and a second end portion formed with a staple ejector which can be moved to align with the staple ejection slot.

6 Claims, 5 Drawing Sheets

STAPLER WITH STAPLES OF DIFFERENT SIZES

The present invention relates to a stapler, and more particularly to a stapler with staples of different sizes.

BACKGROUND OF THE INVENTION

A conventional stapler can work in conjunction with staples of one size only and cannot be used with staples of different sizes, thereby greatly limiting the versatility of the stapler. The present invention has arisen to mitigate and/or obviate the disadvantage of the conventional stapler.

SUMMARY OF THE INVENTION

In accordance with one aspect of the present invention, there is provided a stapler comprising a base including a first end portion and a second end portion, a first staple magazine including a first end portion pivotally connected with the first end portion of the base and a second end portion formed with a closed face and containing a staple ejection slot on the bottom portion thereof, a second staple magazine received in the first staple magazine and including a first end portion connected with the first end portion of the first staple magazine and a second end portion, a plurality of first staples each slidably mounted in the second staple magazine and received in the first staple magazine, a plurality of second staples each slidably received in the second staple magazine, and a pressing cap including a first end portion pivotally mounted on the first end portion of the base and a second end portion formed with a staple ejector which can be moved to align with the staple ejection slot.

Further benefits and advantages of the present invention will become apparent after a careful reading of the detailed description with appropriate reference to the accompanying drawings.

DETAILED DESCRIPTION OF THE PREFERRED EMBODIMENTS

Figure 1:
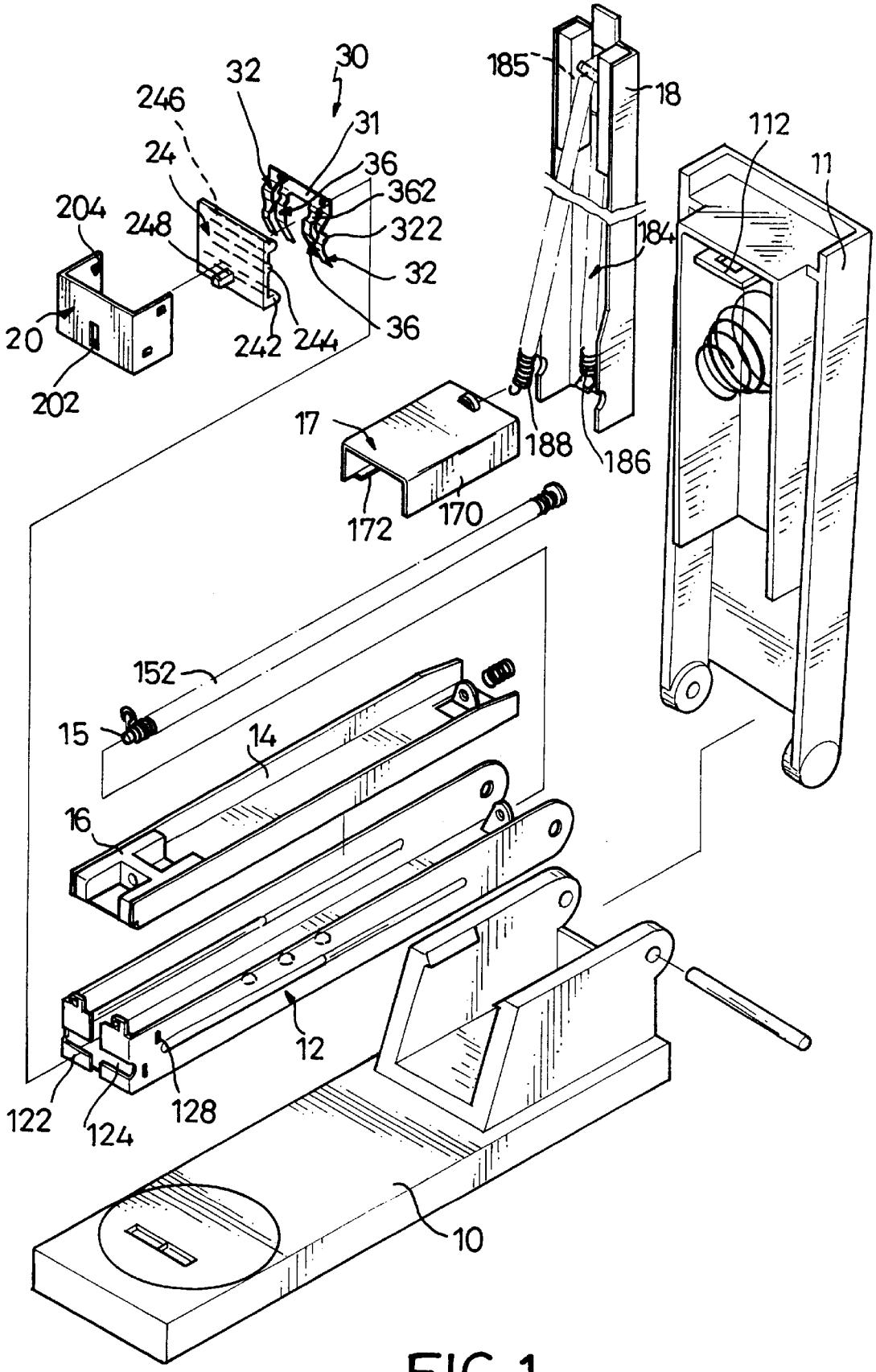
FIG. 1 is an exploded view of a stapler in accordance with the present invention.
Figure 2:
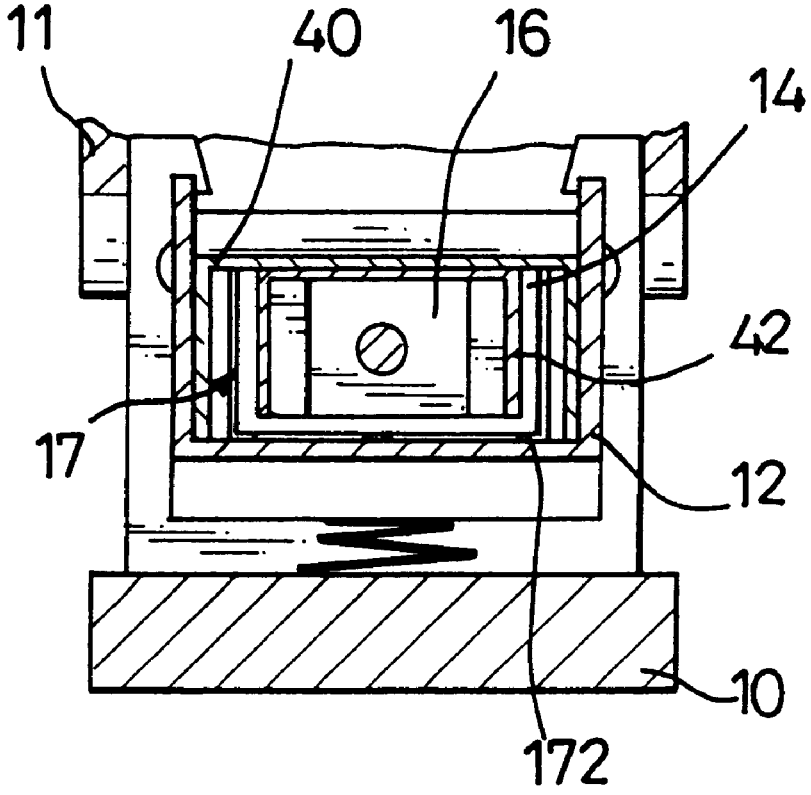
FIG. 2 is a partially cut-away side plan cross-sectional assembly view of the stapler as shown in FIG. 1.
Figure 3:
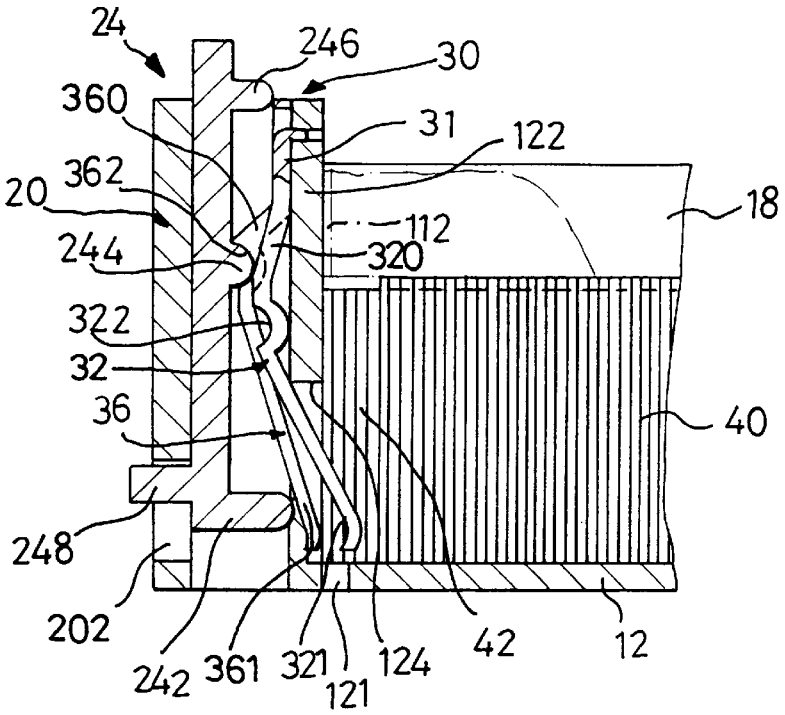
FIG. 3 is a partially cut-away front plan cross-sectional assembly view of the stapler as shown in FIG. 1.

Referring to the drawings and initially to FIGS. 1–3, a stapler in accordance with the present invention comprises a base 10 including a first end portion and a second end portion, a first staple magazine 12 including a first end portion pivotally connected with the first end portion of the base 10 and a second end portion formed with a closed face 122 and containing a staple ejection slot 121 (see FIG. 3) on the bottom portion thereof, a second staple magazine 14 received in the first staple magazine 12 and including a first end portion connected with the first end portion of the first staple magazine 12 and a second end portion, a plurality of first staples 40 each slidably mounted in the second staple magazine 14 and received in the first staple magazine 12, a plurality of second staples 42 each slidably received in the second staple magazine 14 and having a dimension smaller than that of each of the plurality of first staples 40, and a pressing cap 11 including a first end portion pivotally mounted on the first end portion of the base 10 and a second end portion formed with a staple ejector 112 which can be moved to align with the staple ejection slot 121 as shown in FIG. 3.

The stapler further comprises an elongated guiding rod 15 having a first end portion secured to the first end portion of the second magazine 14 and a second end portion, a follower block 16 slidably mounted on the guiding rod 15 and abutting one of the plurality of second staples 42, and a compression spring 152 mounted on the guiding rod 15 and including a first end portion secured to the first end portion of the guiding rod 15 and a second end portion pressing the follower block 16 such that the follower block 16 can be forced by the compression spring 152 to press each of the second staples 42.

The stapler further comprises an inverted U-shaped follower bracket 17 slidably mounted on the second staple magazine 14 and abutting one of the plurality of first staples 40, a follower cap 18 secured in the press cap 11 to pivot therewith and including a first end portion and a second end portion, and a spring 184 reeved around a rod 185 fixed in the follower cap 18 and including a first end portion 186 secured to the first end portion of the follower cap 18 and a second end portion 188 secured to the follower bracket 17 such that the follower bracket 17 can be forced by the spring 184 to press each of the first staples 40. The follower bracket 17 includes two side walls 170 each formed with a retaining flange 172 extending inward and abutting the bottom portion of the second staple magazine 14 such that the follower bracket 17 can slide on the second staple magazine 14 smoothly.

The closed face 122 of the second end portion of the first staple magazine 12 transversely contains an opening 124, and the stapler further comprises an adjusting member 30 comprising a supporting piece 31 secured to the closed face 122 of the first staple magazine 12, two opposite V-shaped flexible first pressing strips 32 each including a first section 320 extending from the outer side of the supporting piece 31 and a second section 321 extending through the opening 124 and detachably abutting one of the plurality of first staples 40, and two opposite V-shaped flexible second pressing strips 36 each including a first section 360 extending from the inner side of the supporting piece 31 and a second section 361 extending through the opening 124 and detachably abutting one of the plurality of second staples 42.

The second section 321 of each of the two first pressing strips 32 contains a first arcuate recess 322, the second section 361 of each of the two second pressing strips 36 contains a second arcuate recess 362 having a height different from that of the first arcuate recess 322, and the stapler further comprises a U-shaped cover 20 fixedly mounted to the second end portion of the first staple magazine 12 and transversely containing an elongated guiding slot 202, and a sliding plate 24 slidably received in the cover 20 and including a first side transversely formed with a control knob 248 slidably received in the guiding slot 202, and a second side formed with an elongated arcuate pressing rib 244 detachably pressing each of the two first pressing strips 32 and each of the two second pressing strips 36.

The second end portion of the first staple magazine 12 transversely contains a plurality of locking cavities 128 therein, and the cover 20 is formed with a plurality of locking bosses 204 each snapped into one of the corresponding locking cavities 128 such that the cover 20 can be secured to the second end portion of the first staple magazine 12. The second side of the sliding plate 24 is formed with a top rib 246 detachably abutting the supporting piece 31 and a bottom rib 242 detachably abutting the closed face 122 of the first staple magazine 12.

In operation, referring now to FIGS. 3–6 with reference to FIGS. 1 and 2, the first staples 40 and the second staples 42 can be pressed by means of the follower bracket 17 and the follower block 16 respectively to align with the staple ejection slot 121 of the first staple magazine 12.

Figure 4:
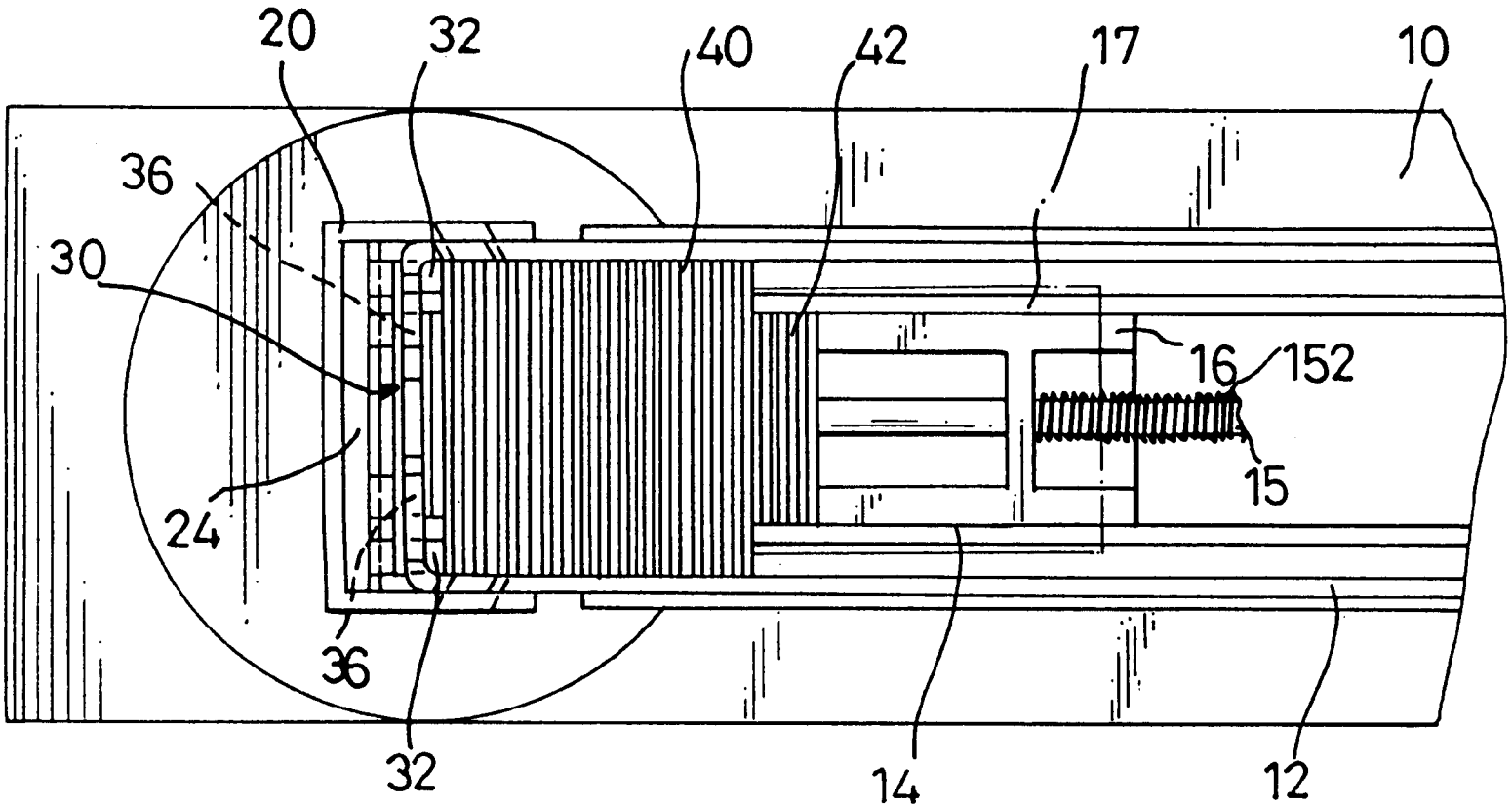
FIG. 4 is a partially cut-away top plan cross-sectional assembly view of the stapler as shown in FIG. 1.

The control knob 248 can then be vertically moved with the sliding plate 24 to slide along the guiding slot 202 to the uppermost position where the pressing rib 244 is received into the second arcuate recess 362 of each of the two second pressing strips 36 and presses each of the two first pressing strips 32 toward the opening 124, thereby forcing the second section 321 of each of the two first pressing strips 32 to abut and press the first staples 40 to detach from the staple ejection slot 121 while the second staples 42 remain aligned with the staple ejection slot 121 as shown in FIGS. 3 and 4 such that the second staples 42 with smaller dimensions can be pressed downward by means of the staple ejector 112 of the pressing cover 11 to pass through the staple ejection slot 121 to be used to staple.

Figure 5:
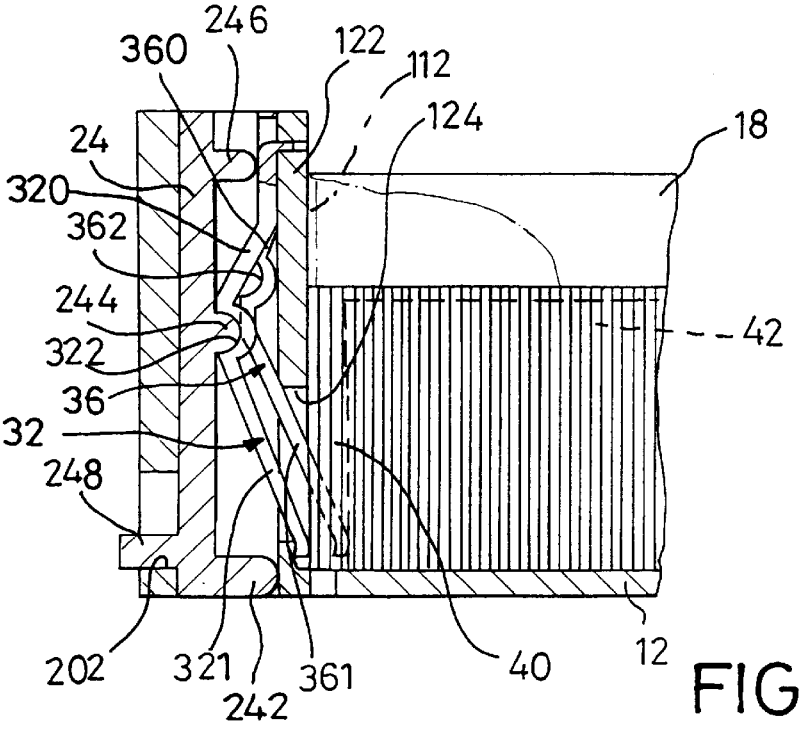
FIG. 5 is an operational view of the stapler as shown in FIG. 3.
Figure 6:
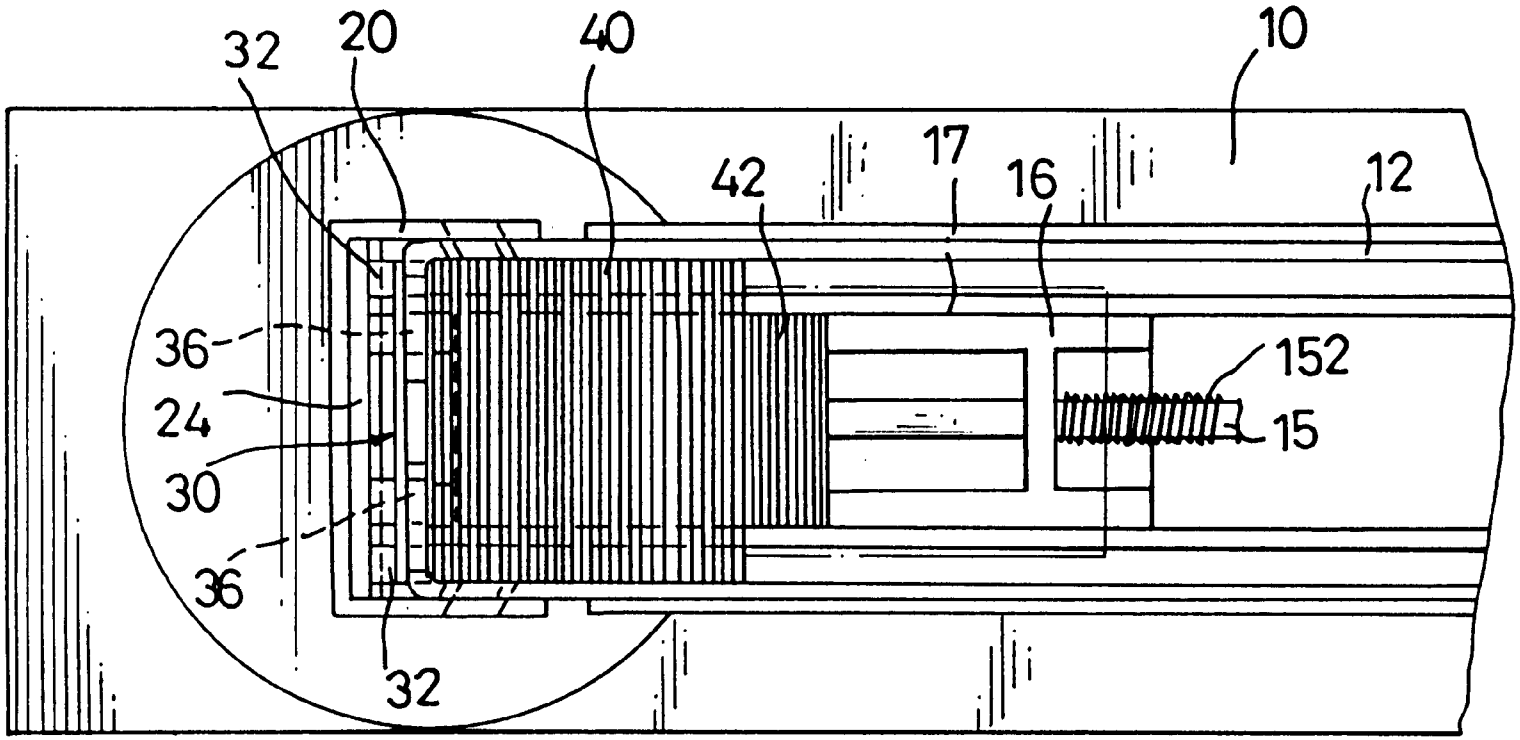
FIG. 6 is an operational view of the stapler as shown in FIG. 4.

The control knob 248 can then be vertically moved with the sliding plate 24 to slide along the guiding slot 202 to the lowermost position where the pressing rib 244 is received into the first arcuate recess 322 of each of the two first pressing strips 32 and presses each of the two second pressing strips 36 toward the opening 124, thereby forcing the second section 361 of each of the two second pressing strips 36 to abut and press the second staples 42 to detach from the staple ejection slot 121 while the first staples 40 remain aligned with the staple ejection slot 121 as shown in FIGS. 5 and 6 such that the first staples 40 with larger dimensions can be pressed downward by means of the staple ejector 112 of the pressing cover 11 to pass through the staple ejection slot 121 to be used to staple.

By such an arrangement, the stapler in accordance with the present invention can be used to provide staples of two different sizes, thereby greatly increasing the versatility thereof.

It should be clear to those skilled in the art that further embodiments may be made without departing from the scope and spirit of the present invention.

What is claimed is:

1. A stapler comprising:

a base (10) including a first end portion and a second end portion;

a first staple magazine (12) including a bottom portion, a first end portion pivotally connected with the first end portion of said base (10) and a second end portion formed with a close face (122) defining an opening (124) therein and containing a staple ejection slot (121) on said bottom portion of said first staple magazine (12);

a second staple magazine (14) received in said first staple magazine (12) and including a first end portion connected with said first portion of said first staple magazine (12), a second end portion and a bottom portion;

a plurality of first staples (40) each slidably mounted in said second staple magazine (14) and received in said first staple magazine (12);

a plurality of second staples (42) each slidably received in said second staple magazine (14);

an adjusting member (30) including a supporting piece (31) secured to said close face (122) of said first staple magazine (12);

two opposite V-shaped flexible first pressing strips (32) each having a first section (320) extending from said supporting piece (31), a second section (321) extending through said opening (124) and detachably abutting one of said plurality of first staples (40) and a first arcuate recess (322);

two opposite V-shaped flexible second pressing strips (36) each having a first section (360) extending from said supporting piece (31), a second section (361) extending through said opening (124) and detachably abutting one of said plurality of second staples (42), and a second arcuate recess (362) having a height different from that of said first arcuate recess (322);

a U-shaped cover (20) fixedly mounted to said second end portion of said first staple magazine (12) and transversely containing an elongated guiding slot (202), and a sliding plate (24) slidably received in said cover (20) and including a first side transversely formed with a control knob (248) slidably received in said guiding slot (202), and a second side formed with an elongated arcuate pressing rib (244) detachably pressing each of said two first pressing strips (32) and each of said two second pressing strips (36), whereby said control knob (248) is slidable in said guiding slot (202) between a first position where said pressing rib (244) is received in said second arcuate recess (362) of each of said two second pressing strips (36) and presses each of said two first pressing strips (32), and a second position where said pressing rib (244) is received in said first arcuate recess (322) of each of said two first pressing strips (32) and presses each of said two pressing strips (36); and a pressing cap (11) including a first end portion pivotally mounted on said first end portion of said base (10) and a second end portion formed with a staple ejector (112) which can be moved to align with said staple ejection slot (121).

2. The stapler in accordance with claim 1, wherein each of said plurality of first staples (40) has a dimension greater than that of each of said plurality of second staples (42).

3. The stapler in accordance with claim 1, further comprising an elongated guiding rod (15) including a first end portion secured to said first end portion of said second magazine (14) and a second end portion, a follower block (16) slidably mounted on said guiding rod (15) and abutting and pressing one of said plurality of second staples (42), and a compression spring (152) mounted on said base 10 and a second end portion pressing said follower block (16).

4. The stapler in accordance with claim 1, further comprising an inverted U-shaped follower bracket (17) slidably mounted on said second staple magazine (14) and abutting and pressing one of said plurality of first staples (40), and pressing means for compressing said follower bracket (17) to press said plurality of first staples (40).

5. The stapler in accordance with claim 4, wherein said follower bracket (17) includes two side walls (170) each formed with a retaining flange (172) extending inward and abutting said bottom portion of said second staple magazine (14).

6. The stapler in accordance with claim 1, wherein said second side of said sliding plate (24) is formed with a top rib (246) detachably abutting said supporting piece (31) and a bottom rib (242) detachably abutting said closed face (122) of said first staple magazine (12).

* * * * *